United States Patent [19]

Hsu

[11] Patent Number: 4,910,897

[45] Date of Patent: Mar. 27, 1990

[54] ROTARY DISPLAY MUSIC BOX

[76] Inventor: Peter Hsu, 4 FL, No. 12, Lane 377, Lung Chiang Road, Taipei, Taiwan

[21] Appl. No.: 248,819

[22] Filed: Sep. 26, 1988

[51] Int. Cl.[4] ..... G09F 27/00

[52] U.S. Cl. ..... 40/456; 40/473; 446/265; 272/31 R

[58] Field of Search ..... 40/455–457, 40/473, 474; 446/303, 352, 298, 265; 272/31 R, 31 P

[56] References Cited

U.S. PATENT DOCUMENTS

| | | | |
|---|---|---|---|
| 2,621,429 | 12/1952 | Teich | 40/152.1 |
| 3,246,423 | 4/1966 | Glass et al. | 446/303 |
| 4,753,436 | 6/1988 | Sinclair | 272/31 R |

*Primary Examiner*—Kenneth J. Dorner
*Assistant Examiner*—J. Hakomaki
*Attorney, Agent, or Firm*—Erik M. Arnhem

[57] ABSTRACT

A rotary music box adapted for use on special occasions, such as baby showers, birthdays and weddings. Space is provided on the rotating music box for displaying photographs or cards pertinent to the event being celebrated.

6 Claims, 1 Drawing Sheet

ROTARY DISPLAY MUSIC BOX

BACKGROUND AND SUMMARY OF THE INVENTION

This invention relates to rotary music boxes, especially music boxes for special occasions, such as birthdays, baby showers, bridal showers, wedding anniversaries, and Christmas or other holidays.

Rotary music boxes are already known. See for example U.S. Pat. Nos. 4,573,939 to C. Hoshino, or 3,349,661 to F. Searles, or 2,840,949 to J. Faulkner. Such prior art music boxes are what I would term "general purpose" constructions having a fixed standard appearance that cannot be varied to meet different circumstances or individual situations.

My invention contemplates a rotary music box that can have its appearance changed to meet individual tastes and/or special party situations, e.g. a child's birthday or a bridal shower, or a wedding.

The music box of this invention includes a rotary turnable having a plural number of three dimensional figures "positioned" on the table surface in outwardly-facing attitudes. For example, in the case of a child's birthday one figure could be a small teddy bear, another figure could be a miniature jack-in-the-box, and a third figure could be a duck.

The three-dimensional figures are preferably detachably mounted on the rotary table, so that the figures can be replaced with other figures appropriate to other party situations. The space in front of one of the three dimensional figures is occupied by a small annular rectangular frame adapted to releasably display a photograph of persons or scenes appropriate to particular situations, e.g. two people in wedding attire, or a newborn baby, or a smiling child, or a baby's footprint, etc. The displayed photograph can be changed to meet each special situation.

The preferred music box includes an annular cylindrical skirt depending from the outer edge of the turntable. Special flange-type retaining mechanisms are carried on the cylindrical skirt for displaying additional photographs, decorative cards, birthday gift paper, Christmas paper, wedding invitations, etc. of a sentimental or festive nature.

THE DRAWINGS

DESCRIPTION OF A PREFERRED EMBODIMENT OF THE INVENTION

Figure 1:
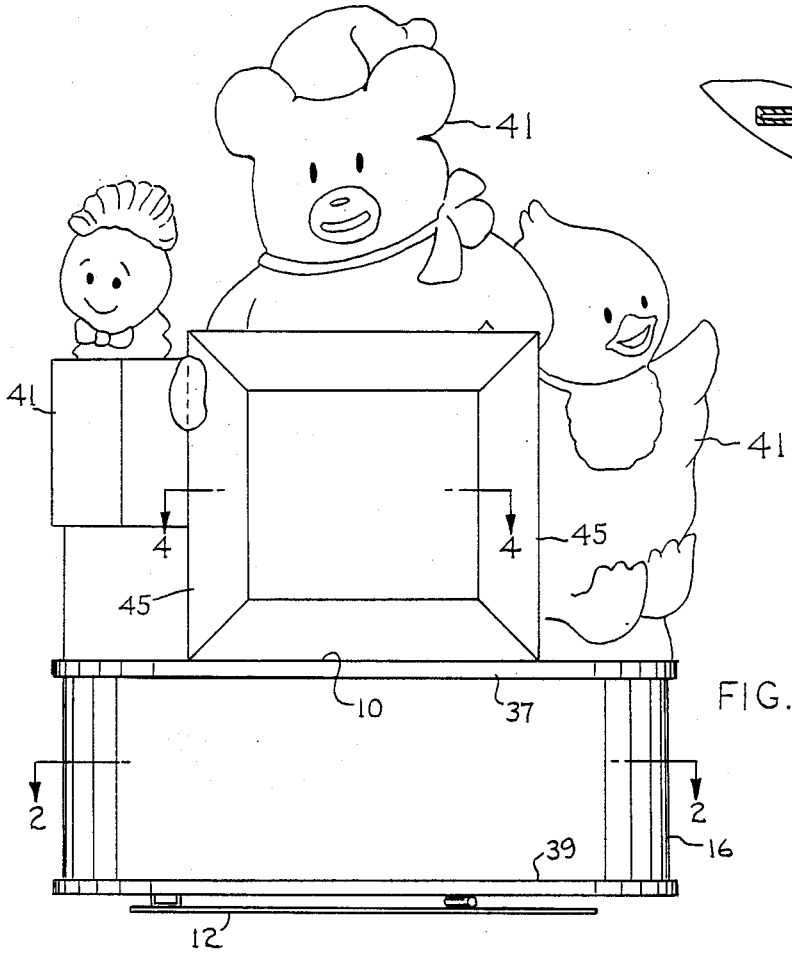
FIG. 1 is an elevational view of a rotary music box embodying my invention.

The drawings show a rotary music box comprising a circular table 10 spaced an appreciable distance above a stationary circular base plate 12. Table 10 is adapted to rotate around the central vertical axis 14.

An annular cylindrical skirt 16 depends from the outer peripheral edge of table 10 to a point just above the base plate 12. Plate 12 has a plan dimension (diameter) that is appreciably less than the diameter of table 10 and skirt 16. Therefore, the skirt substantially conceals base 12 from view. The viewer sees only the rotating unit, comprised of table 10 and skirt 16 (along with a number of three dimensional figures positioned on the upper face of table 10).

A circular bottom plate 17 is connected to cylindrical skirt 16 at its lower edge, i.e. a slight distance above the base plate 12. An electric motor means 19 is carried on a separate plate structure 20 that is riveted or otherwise attached to the upper face of bottom plate 17. The motor shaft 21 extends downwardly through plate 17 into a square socket structure 23 attached to base 12. The extreme lower end of shaft 21 has a square cross-section to mate with socket structure 23, so that when motor means 19 is energized shaft 21 will remain fixed to base 12 while plate 17 (and attached members 16 and 10) rotate around shaft axis 14. The turntable assembly may be support against undesired wobble by means of three or more support rollers 24 suitably mounted on the upper face of plate 12.

Electric motor means 19 may be supplied with current from a dry cell battery 25 suitably positioned on plate 17. The lead wires from the battery are in circuit with motor means 19 and an on-off manual switch 27 attached to the undersurface to table 10. A manual switch-actuator button 29 extends from the switch through table 10 so that it is accessible through the space above the table surface.

Motor shaft 21 is attached to a small ring gear 30 that is in mesh with a bevel gear 32 attached to the end face of a rotary cylinder 33. Pins project radially outwardly from the cylinder surface to strike metallic times 34 as gears 30 and 32 cause cylinder 33 to rotate around its axis. Tine vibration produces a musical tune related to the spacing of the pins on cylinder 33.

Figure 3:
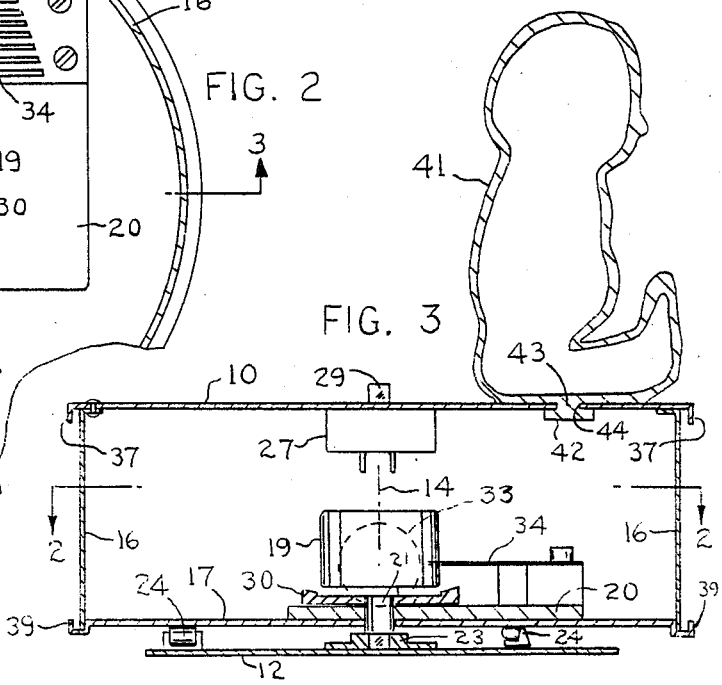
FIG. 3 is a fragmentary sectional view taken on line 3—3 in FIG. 2.

Referring especially to FIG. 3, table 10 has at its outer edge a downwardly extending peripheral flange 37; the flange extends entirely around the table edge. Also, another peripheral flange 39 extends upwardly from the lower edge of skirt 16; this flange extends entirely around the skirt in axial alignment with flange 37. Flanges 37 and 39 are spaced a slight distance outwardly from the curved outer face of skirt 16, such that photographs or other flexible display material (e.g. Christmas wrapping paper or thin cardboard, plastic, etc.) can be bent and inserted into the slot-like spaces defined by the flanges. The photographs or display sheet materials are selected by the user as the occasion may require, e.g. child's birthday, wedding, anniversary, baby shower, etc.

A number of three dimensional figures 41 are positioned uncovered on the upper face of table 10. Each figure is preferably different, e.g. a simulated teddy bear, or a simulated duck, etc. The figures may be hollow to minimize weight and material costs. Also, the figures are preferably releasably attached to table 10, whereby the figures can be replaced with other simulations to meet particular party situations. The detachable connection means can be varied as to detail. FIG. 3 shows the connection as an elongated bar 42 attached to the base surface of the simulation via a thin neck 43. A slot 44 is formed in table 10 to the shape of bar 42. After the bar has been inserted through slot 44 the simulation 41 is turned about ninety degrees so that bar 42 is crosswise of the associated slot, thereby retaining the simulated figure in place on table 10. One or more of the hollow figures can have a coin slot therein, so that the figure can act as a piggy bank.

Figure 4:
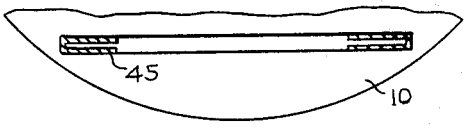
FIG. 4 is a fragmentary sectional view taken on line 4—4 in FIG. 1.
Figure 2:
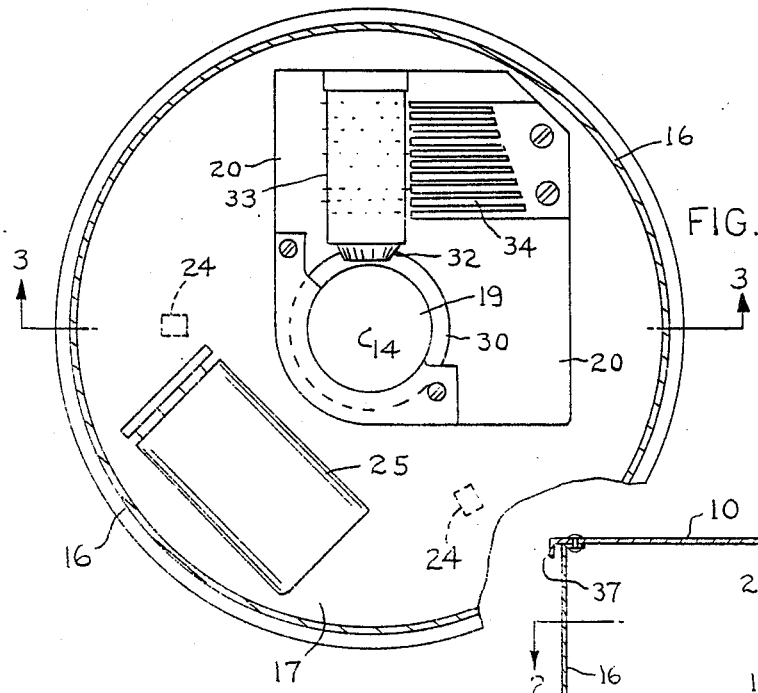
FIG. 2 is a sectional view taken on line 2—2 in FIGS. 1 and 3.

The three dimensional figures 41 are preferably arranged so as to face outwardly away from the table axis, as shown for example in FIG. 1. The space in front of one of the figures is occupied by an upright rectangular frame structure 45. As shown in FIG. 4, the walls of frame structure 45 have a channel cross section for containment of a photograph appropriate to each special occassion. An elongated slot is provided in (along) the upper wall of the frame structure for insertion or removal of the photograph.

The invention contemplates a versatile rotary music box that can be customized or personalized in accordance with the user's desires or needs. At a party one of the music boxes can be placed in the center of each table. Decorations, photographs and cards of sentimental value can be inserted into frame structure 45 and also around skirt 16. Each person in the immediate vicinity of the music box will be able to view all of the displayed material in sequence as the circular box rotates around its central axis .

I claim:

1. A music box comprising a base:

a circular table spaced an appreciable distance above the base;

an annular cylindrical skirt depending from the periphery of the circular table to a point substantially in horizontal alignment with the base;

said base having a plan dimension that is substantially less than the diameter of the circular table and the associated skirt, whereby the skirt substantially conceals the base from view;

electric motor means disposed in the space circumscribed by the cylindrical skirt for rotating the table and associated skirt;

a plural number of three dimensional figures positioned uncovered on the circular table, with each three dimensional figure facing outwardly away from the table axis; said figure include means thereon for releasably attaching said figure to the circular table;

means supported on the circular table for releasably positioning a photograph in an upright attitude in front of one of the three dimensional figures; said means comprises an annular rectangular frame having a channel cross-section for encirclement of the border areas of a photograph; one wall of the rectangular frame having a slot therein for insertion or removal of a photograph;

means releasably retaining photographs and/or decorative cards against the outer surface of the cylindrical skirt, whereby the depicted material is sequentially viewed as the skirt rotates around the table axis; said retaining means comprises a downwardly-extending peripheral flange at the outer edge of the circular table; and an upwardly-extending peripheral flange at the lower end of the skirt; each flange being being spaced a slight distance outwardly from the skirt surface to form a retaining mechanism for photographs or decorative cards.

2. The music of claim 1 and further comprising a circular bottom plate connected to the cylindrical skirt as its lower edge; said electric motor means being mounted on said bottom plate.

3. The music box of claim 1, wherein one or more of the figures are hollow provided with a coin slot therein.

4. The music box of claim 2 wherein said electric motor means includes a drive shaft extending downwardly through the bottom plate to a fixed connection with said base.

5. The music box of claim 2 and further comprising an on-off switch for the electric motor-means; said switch being mounted on the underside of the circular table.

6. The music box of claim 5 wherein said on-off switch includes a manual actuation means extending through the circular table.

* * * * *